US010378528B2

(12) United States Patent
Klügl

(10) Patent No.: US 10,378,528 B2
(45) Date of Patent: Aug. 13, 2019

(54) PUMP UNIT FOR REDUCING AGENTS IN AN EXHAUST GAS PURIFICATION SYSTEM

(71) Applicant: Continental Automotive GmbH, Hannover (DE)

(72) Inventor: Wendelin Klügl, Seubersdorf (DE)

(73) Assignee: Continental Automotive GmbH, Hannover (DE)

( * ) Notice: Subject to any disclaimer, the term of this patent is extended or adjusted under 35 U.S.C. 154(b) by 117 days.

(21) Appl. No.: 15/524,771

(22) PCT Filed: Nov. 5, 2015

(86) PCT No.: PCT/EP2015/075806
§ 371 (c)(1),
(2) Date: May 5, 2017

(87) PCT Pub. No.: WO2016/071443
PCT Pub. Date: May 12, 2016

(65) Prior Publication Data

US 2018/0306177 A1 Oct. 25, 2018

(30) Foreign Application Priority Data

Nov. 6, 2014 (DE) ..... 10 2014 222 743

(51) Int. Cl.
*F04B 43/02* (2006.01)
*F01N 3/20* (2006.01)
*F04B 53/00* (2006.01)

(52) U.S. Cl.
CPC ..... *F04B 43/025* (2013.01); *F01N 3/2066* (2013.01); *F04B 43/02* (2013.01); *F01N 2610/1433* (2013.01); *F04B 53/008* (2013.01)

(58) Field of Classification Search
CPC .... F04B 43/021; F04B 53/008; F01N 3/2066; F01N 2610/1433
See application file for complete search history.

(56) References Cited

U.S. PATENT DOCUMENTS 2,070,738 A * 2/1937 Klein ..... F04C 5/00 418/154
2,946,291 A * 7/1960 Roebig ..... F04C 2/04 418/56
3,408,947 A * 11/1968 McMillan ..... F04B 43/14 418/45
4,332,534 A * 6/1982 Becker ..... F04B 43/14 418/153

(Continued)

FOREIGN PATENT DOCUMENTS

CN 103518046 1/2014
DE 859477 C 12/1952

(Continued)

*Primary Examiner* — Thomas E Lazo
(74) *Attorney, Agent, or Firm* — Cozen O'Connor

(57) ABSTRACT

A pump for reducing agents of an exhaust gas purification system for an internal combustion engine of a motor vehicle includes: a diaphragm carrier; a diaphragm arranged on the diaphragm carrier, the diaphragm having a radially outer collar; and a pump housing configured to secure the radially outer collar of the diaphragm. The radially outer collar of the diaphragm has a reinforcing ring.

6 Claims, 1 Drawing Sheet

(56) References Cited

U.S. PATENT DOCUMENTS

| | | | | | |
|---|---|---|---|---|---|
| 4,573,885 | A * | 3/1986 | Petersen | F04B 43/067 417/383 |
| 4,828,464 | A * | 5/1989 | Maier | F04B 43/067 324/207.21 |
| 5,192,198 | A * | 3/1993 | Gebauer | F04B 43/067 417/305 |
| 5,261,798 | A * | 11/1993 | Budde | F04B 9/135 417/393 |
| 5,306,122 | A | 4/1994 | Gebauer et al. | |
| 6,299,419 | B1 | 10/2001 | Hunklinger et al. | |
| 6,742,997 | B2 * | 6/2004 | Murata | F04B 43/0736 417/395 |
| 10,240,503 | B2 * | 3/2019 | Hodgson | F01N 3/2066 |

FOREIGN PATENT DOCUMENTS

| | | | | | |
|---|---|---|---|---|---|
| DE | 44 10 022 | A1 | | 5/1995 | |
| DE | 10 2008 054686 | A1 | | 6/2010 | |
| DE | 102008054686 | A1 | * | 6/2010 | F01N 3/208 |
| DE | 10 2010 028850 | A1 | | 11/2011 | |
| DE | 102010028850 | A1 | * | 11/2011 | F01N 3/208 |
| DE | 102012221492 | | | 5/2014 | |
| EP | 0 417 402 | A2 | | 3/1991 | |
| WO | WO 98/53208 | | | 11/1998 | |
| WO | WO 2012/152498 | A1 | | 11/2012 | |
| WO | WO-2012152498 | A1 | * | 11/2012 | F01N 3/2066 |

* cited by examiner

PUMP UNIT FOR REDUCING AGENTS IN AN EXHAUST GAS PURIFICATION SYSTEM

CROSS-REFERENCE TO RELATED APPLICATIONS

This is a U.S. national stage of application No. PCT/EP2015/075806, filed on 5 Nov. 2015, which claims priority to the German Application No. 10 2014 222 743,7 filed 6 Nov. 2014, the content of both incorporated herein by reference.

BACKGROUND OF THE INVENTION

1. Field of the Invention

The invention relates to a pump for reducing agents of an exhaust gas purification system, a diaphragm arranged on a diaphragm carrier, and a pump housing for securing a radially outer collar of the diaphragm.

2. Related Art

An exhaust gas purification system for a pump of this type is known from DE 44 10 022 A1. In the exhaust gas purification system, a metering system is provided, via which a reducing agent can be fed to a catalytic converter.

In practice, pump stages configured as positive displacement pumps are known, for metering systems of this type. As viewed from the radially outer collar, the diaphragm is clamped in radially inside between housing parts of the pump housing. In the case of the known pump stages, a leak is frequently produced between the pump housing and the radially outer collar of the diaphragm. A leak of this type leads to functional disruptions up to the failure of the entire system.

SUMMARY OF THE INVENTION

An object of the invention is to address the problem of developing a pump of the above-mentioned type so as to provide a pump that has a particularly reliable tightness.

According to an aspect of the invention, the above-mentioned problem may be solved by the radially outer collar of the diaphragm having a reinforcing ring.

By way of this configuration, the radially outer collar with the reinforcing ring can be clamped in and pressed under prestress between two housing parts of the pump housing. This already ensures a particularly reliable tightness on the outer collar of the diaphragms. As a result, leaks are avoided in the radially inner (as viewed from the radially outer collar) region of the diaphragms. By way of this configuration, reliable functioning of the overall exhaust gas purification system is additionally ensured.

In this way, the pump stage is suitable, in particular, for use in what are known as Selective Catalytic Reduction (SCR) pumps.

According to another advantageous development of the invention, a contribution is made to the further increase of the reliability of the tightness of the pump stage if the radially outer collar of the diaphragm completely fills a holding groove produced by the housing parts.

According to another advantageous development of the invention, the fastening of the reinforcing ring in the pump housing is of particularly simple design if the reinforcing ring is clamped in between two housing parts of the pump housing.

According to another advantageous development of the invention, the pump stage has particularly high stability if the reinforcing ring is produced from metal.

According to another advantageous development of the invention, a contribution is made to the further increase of the reliability of the tightness of the pump stage if the reinforcing ring is connected in an integrally joined manner to elastomeric material of the diaphragm. The integrally joined connection can be produced, for example, by way of the reinforcing ring being vulcanized on.

According to another advantageous development of the invention, a particularly reliable seat of the reinforcing ring on the pump housing can be ensured simply if the reinforcing ring is pressed onto the pump housing.

BRIEF DESCRIPTION OF THE DRAWINGS

The invention permits numerous embodiments. For further clarification of its fundamental principle, two of the embodiments are shown in the drawings and will be described in the following text. In the drawings.

DETAILED DESCRIPTION OF THE PRESENTLY PREFERRED EMBODIMENTS

Figure 1:
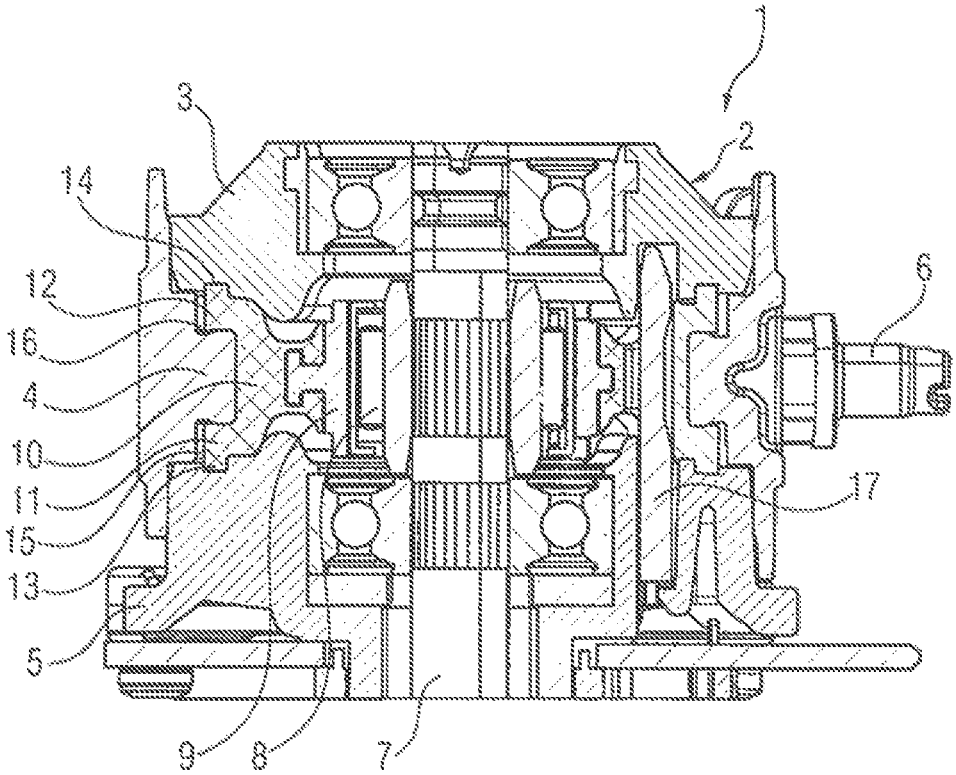
FIG. 1 shows a sectional illustration through a pump stage.

FIG. 1 shows a sectional illustration through a pump stage 1, configured as an orbital pump, for reducing agent of an exhaust gas purification system (not shown) for an internal combustion engine of a motor vehicle. An exhaust gas purification system of this type is known, for example, from DE 44 10 022 A1.

The pump stage 1 has a pump housing 2 that includes a plurality of housing parts 3, 4 and 5. The pump housing 2 has a connector 6 for delivering the reducing agent. Within the pump housing 2, a drive shaft 7 is mounted rotatably and is mounted via an anti-friction bearing 8 on a diaphragm carrier 9. The diaphragm carrier 9 is connected to the radially inner region of a diaphragm 10. The diaphragm 10 has two radially outer collars 11, 12 which are clamped in, in each, case between two housing parts 3 and 5. The housing parts 3 and 5 have circumferential holding grooves 13, 14 for the collars 11, 12. It can be seen clearly that the collars 11, 12 of the diaphragm 10 completely fill the holding grooves 13, 14. As a result of their shape, the collars 11, 12 in each case form a reinforcing ring 15, 16 of the diaphragm 10. Furthermore, FIG. 1 shows a separating chamber pin 17 of the pump stage 1.

Figure 2:
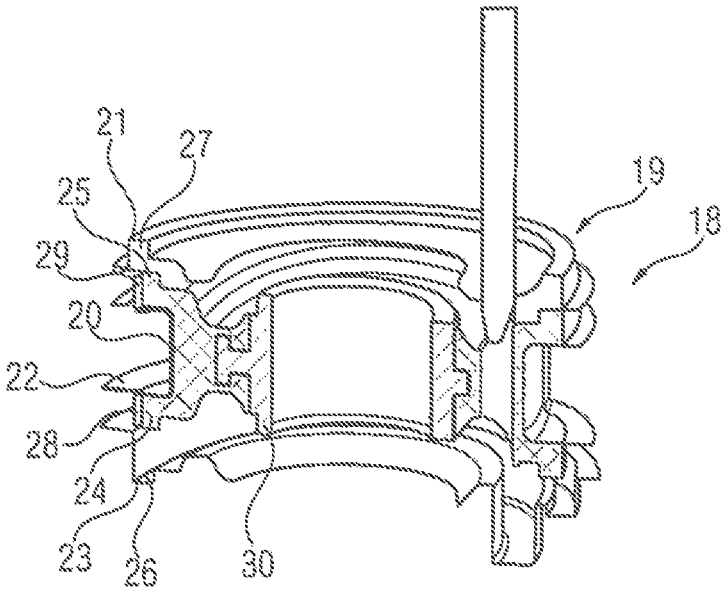
FIG. 2 shows a further embodiment of the pump stage.

FIG. 2 shows a part region of a further embodiment of a pump stage 18 having a pump housing 19 before being mounted on a diaphragm 20. The pump housing 19 has three housing parts 21, 22 and 23. On its radially outer region, the diaphragm 20 has two circumferential collars 24, 25 which completely fill a holding groove 26, 27 which is formed by the housing parts. In addition, the collars 24, 25 in each case have a reinforcing ring 28, 29 made from metal. In the assembled state of the pump stage 18, the reinforcing rings 28, 29 are pressed onto the housing parts 21 and 23. The diaphragm 20 is fastened on a diaphragm carrier 30.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention; therefore, to be limited only as indicated by the scope of the claims appended hereto.

The invention claimed is:

1. A pump for reducing agents of an exhaust gas purification system for an internal combustion engine of a motor vehicle, the pump comprising:

a diaphragm carrier;

a diaphragm arranged on the diaphragm carrier, the diaphragm having a radially outer collar; and a pump housing configured to secure the radially outer collar of the diaphragm, wherein the radially outer collar of the diaphragm has a reinforcing ring entirely arranged on a radially outermost portion of the radially outer collar.

2. The pump as claimed in claim 1, further comprising a holding groove defined by housing parts of the pump housing, wherein the radially outer collar of the diaphragm completely fills the holding groove.

3. The pump as claimed in claim 1, wherein the reinforcing ring is clamped between two housing parts of the pump housing.

4. A pump for reducing agents of an exhaust gas purification system for an internal combustion engine of a motor vehicle, the pump comprising:

a diaphragm carrier;

a diaphragm arranged on the diaphragm carrier, the diaphragm having a radially outer collar; and a pump housing configured to secure the radially outer collar of the diaphragm, wherein the radially outer collar of the diaphragm has a reinforcing ring, and wherein the reinforcing ring comprises metal.

5. The pump as claimed in claim 1, wherein the reinforcing ring is connected in an integrally joined manner to elastomeric material of the diaphragm.

6. The pump as claimed in claim 1, wherein the reinforcing ring is pressed on the pump housing.

* * * * *